United States Patent [19]

Roberts et al.

[11] Patent Number: 5,027,490

[45] Date of Patent: Jul. 2, 1991

[54] APPARATUS FOR INSERTING FASTENERS

[75] Inventors: Bradley M. Roberts, Williamsville; James L. Birke, North Tonawanda, both of N.Y.

[73] Assignee: Gemcor Engineering Corporation, Buffalo, N.Y.

[21] Appl. No.: 497,109

[22] Filed: Mar. 21, 1990

Related U.S. Application Data

[62] Division of Ser. No. 314,415, Feb. 22, 1989, Pat. No. 4,998,943.

[51] Int. Cl.[5] ..... B23B 11/00

[52] U.S. Cl. ..... 29/34 B; 29/243.54; 29/564.2; 29/715; 81/463; 173/138; 227/61

[58] Field of Search ..... 29/33 K, 34 B, 715, 29/243.53, 243.54, 564.1, 564.2; 227/60, 61, 51, 69; 81/463; 173/134, 138

[56] References Cited

U.S. PATENT DOCUMENTS

| | | | |
|---|---|---|---|
| 4,658,913 | 4/1987 | Yantsen et al. | 173/134 |
| 4,864,713 | 9/1989 | Roberts et al. | 29/524.1 |
| 4,908,928 | 3/1990 | Mazurik et al. | 29/243.54 |
| 4,936,393 | 6/1990 | Lister | 173/134 X |

OTHER PUBLICATIONS

SME Technical Paper AD86-686, Tom D. Stone, 1986, "No Tack Assembling of Wing Span and Spar Assemblies".

SME Technical Paper AD84-842, Robert B. Starnes, 1984, "Two Piece Fasteners and Installation Tooling".

*Primary Examiner*—Mark Rosenbaum
*Assistant Examiner*—Frances Chin
*Attorney, Agent, or Firm*—Hodgson Russ Andrews Woods & Goodyear

[57] ABSTRACT

An apparatus for inserting fasteners which are press fit through aligned apertures in side-by-side workpieces. The apparatus includes a frame which is moveable relative to the side-by-side workpieces, the frame including a main frame and a subframe mounted on the main frame and moveable between the first and second positions. The subframe carries tooling in the form of a drill and an upper ram. Also, mounted on the main frame are upper and lower spaced apart clamps which may be selectively moved into contact with upper and lower surfaces of upper and lower workpieces. The upper ram can be moved into contact with a headed fastener to force the shank of the fastener through aligned apertures drilled in the workpieces. A vibrating apparatus is associated with the upper ram and will be operated to hammer the upper ram while it is still being maintained in contact with the fastener after the fastener has been inserted into the workpieces to fully insert the fastener and relieve any stresses which may be present. Subsequently a collar may be swaged about the end of the fastener which projects through the workpieces.

11 Claims, 5 Drawing Sheets

| | 86 | 200 | 202 | 204 | 206 | 208 | 210 | 212 |
|---|---|---|---|---|---|---|---|---|
| START | R | R | C | L | R | B | O | D |
| 1 | R | L | C | L | R | B | O | D |
| 2 | R | L | R | L | R | B | O | D |
| 3 | R | L | C | L | R | B | O | D |
| 4 | L/R | L | C | L | R | B | O | D |
| 5 | R | L | C | L | R | B | O | D |
| 6 | R | L | C | R | R | B | O | D |
| 7 | R | L | C | R | C | B | B | D |
| 8 | R | L | C | R | C | B | B | L |
| 9 | R | L | C | R | C | B | B | L |
| 10 | R | L | C | R | C | O | B | L |
| 11 | R | L | C | R | C | B | B | D |
| 12 | R | L | C | R | C | B | B | D |
| 13 | R | L | C | R | R | B | O | D |
| 14 | R | L | C | L | R | B | O | D |
| 15 | R | L | L | L | R | B | O | D |
| 16 | R | L | C | L | R | B | O | D |
| 17 | R | L | C | L | R | B | O | D |
| 18 | R | R | C | L | R | B | O | D |
| 19 | R | R | C | L | R | B | O | D |

Fig. 12.

B — BLOCKED
C — CENTERED
D — OPEN TO RESERVOIR
L — LOWER
O — OPEN TO PRESSURE
R — RAISE

APPARATUS FOR INSERTING FASTENERS

CROSS-REFERENCE TO RELATED APPLICATIONS

The present application is division of U.S. patent application Ser. No. 07/314,415, filed Feb. 22, 1989 now U.S. Pat. No. 4,998,943.

TECHNICAL FIELD

The present invention relates generally to an apparatus for inserting fasteners into two or more workpieces, and more specifically to an apparatus for installing fasteners wherein a fastener is forced through aligned apertures in side-by-side upper and lower workpieces, which apparatus provides for vibrating the fastener to fully insert the fastener and relieve any stresses which may be present.

BACKGROUND OF THE INVENTION

In the aircraft industry one commonly used fastener is the stump type two-piece non-threaded pin/collar lockbolt fastener system. This system includes a pin which is force fit by compressive forces through two aligned apertures in side-by-side workpieces, and a collar which is then swaged about the lower end of the pin, which pin is provided with a series of annular grooves. While there are many advantages to this form of fastener it has been found that stresses will be developed when forcing the pin into the aligned aperture, and also that the pin on occasion may not be fully seated. These disadvantages may be overcome by impacting the fastener with a hammer or the like to relieve stresses and to insure that it is fully seated before the collar swaged about the lower end of the pin.

While the above process can be done when using hand tooling, it has not been practical with automated tooling. As manufacturing organizations have been facing the ever increasing twin pressures of improving productivity and enhancing quality, automation in various forms is being utilized to overcome the problems of spiraling assembly costs and marketplace demands for improved consistency of product quality. Thus, riveting machines have been developed which can move along large workpieces, such as for example the wing of a commercial jet aircraft, while drilling the workpieces and while installing rivets. These machines may be modified to insert pin collar fasteners as well as other fasteners such as nuts and bolts where precise positioning, drilling, and compressive forces during installation may be required. Thus, automatic collar feeding devices have been designed to be added to a drill/riveting machine in the same manner as any lower tooling, the function of the collar feeding device being to store and automatically feed into position a collar which is then, in proper sequence, swaged on to a lock bolt stump pin already inserted into the workpiece from the overhead mechanism of the drill/riveting machine. By utilizing this form of machinery substantially consistent fastener insertion and securement can be accomplished. However, with this apparatus it has not been possible to vibrate or impact the fastener after insertion to either relieve stresses or to insure that the fastener is fully inserted.

OBJECTS AND SUMMARY OF THE PRESENT INVENTION

It is a principal object of the present invention to provide an apparatus for relieving stresses and fully seating a fastener which has been force fit into aligned apertures in side-by-side workpieces.

More particularly, it is an object of the present invention to provide an apparatus for installing fasteners in side-by-side workpieces wherein the apparatus includes a ram, and wherein the ram is moved toward the workpieces to force the fastener into the workpieces and also wherein the ram is vibrated while still in contact with the fastener to fully insert the fastener and to relieve any stresses which may be present.

It is a further object of the present invention to provide an apparatus of the type set forth above wherein aligned apertures are drilled through side-by-side workpieces by the same apparatus which carries the ram.

It is yet another object of the present invention to provide an apparatus for forcing a fastener into side-by-side workpieces, vibrating the fastener after insertion with the same tooling utilized to insert the fastener, and then to swage a collar about that end of the fastener which has been forced through the two side-by-side workpieces.

The foregoing objects of the present invention as well as additional objects are accomplished by providing an apparatus including a frame which is moveable relative to side-by-side workpieces, the frame including a main frame and a subframe mounted on the main frame and moveable between the first and second positions, the subframe carrying tooling in the form of a drill and an upper ram. Also, mounted on the main frame are upper and lower spaced apart clamps which may be selectively moved into contact with upper and lower surfaces of upper and lower workpieces. The upper ram can be moved into contact with a fastener to force the fastener through aligned apertures drilled in the workpieces, and ram vibrating means are associated with the upper ram to hammer the upper ram while it is still being maintained in contact with the fastener after the fastener has been inserted into the workpieces to fully insert the fastener and relieve any stresses which may be present.

The foregoing will become more fully understood after a consideration of the following detailed description taken in conjunction with the accompanying drawings in which a preferred form of this invention is illustrated.

BRIEF DESCRIPTION OF THE DRAWINGS

FIG. 12 is a table illustrating the position of the various control valves shown in FIG. 2 at the completion of each of the operational steps of this invention.

DETAILED DESCRIPTION

Figure 1:
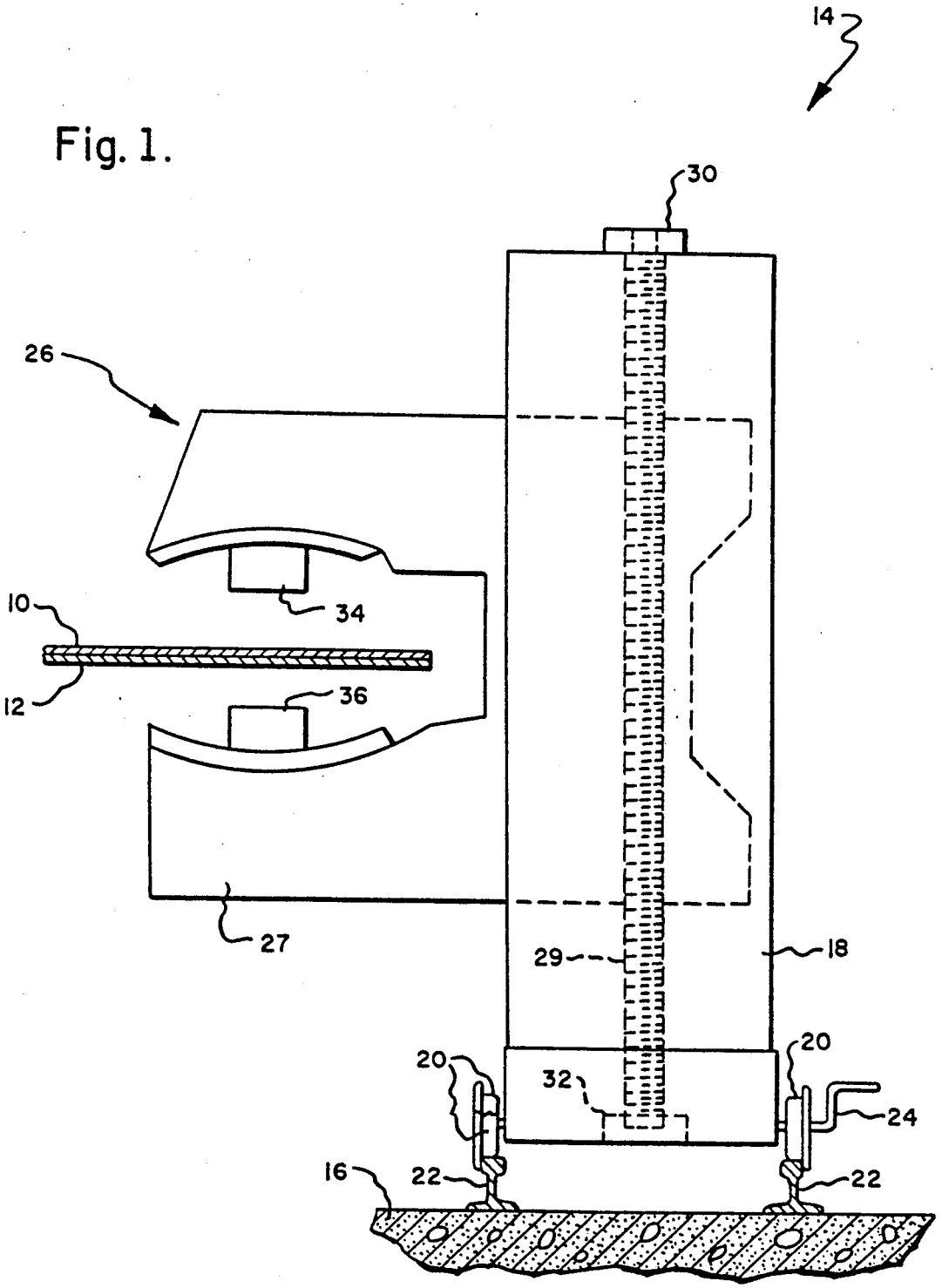
FIG. 1 is a side elevational somewhat schematic illustration of the apparatus in which the principles of the present invention have been incorporated.
Figure 2:
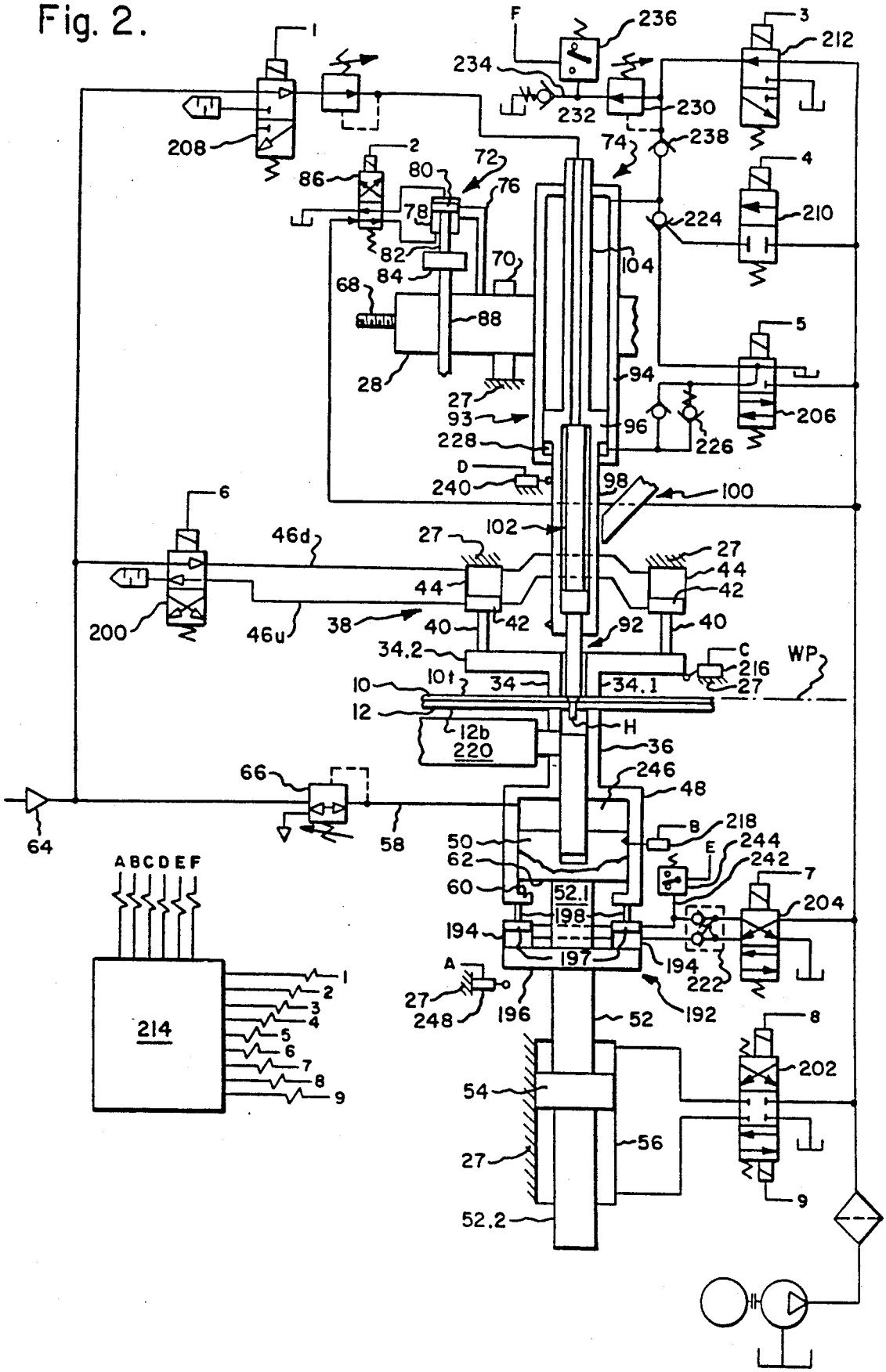
FIG. 2 is a schematic illustration of a portion of the apparatus of this invention showing tooling and clamps carried by the frame and various control devices, the parts being shown in that position which they would occupy after the completion of step 10 below.

Reference will be made initially to FIGS. 1 and 2 in which the apparatus of this invention is illustrated. Upper and lower workpieces which are to be joined together are indicated at 10 and 12, respectively. While only two workpieces are illustrated in the figures, it should be appreciated that more than two workpieces could be joined together by the fastener inserting apparatus of this invention, which fastener inserting apparatus is indicated generally at 14 in FIG. 1. Because of the size of the workpieces, which may be a complete wing assembly for a commercial jet aircraft, the workpieces 10 and 12 will be held generally stationary with respect to the floor or base 16 upon which the apparatus rests and the apparatus 14 will be moved along the floor to various fastener insertion positions as a number of separate fasteners will be utilized to hold the workpieces together. The apparatus includes a main structure 18 which is provided at its lower end with rail wheels 20 which rest upon rails 22 secured to the base or floor 16. The structure may be moved upon the rails in any conventional manner and thus, for purposes of illustration, means in the form of a crank 24 is shown for moving the apparatus relative to the workpieces 10 and 12.

Mounted upon the main structure 18 is a frame indicated generally at 26, which frame 26 includes a main frame 27 and a subframe 28 (FIG. 2). The frame 26 may be moved relative to the structure 18. Thus, the frame 26 as shown in FIG. 1 may be moved up and down relative to the structure 18, as well as to the right or left, and in other manners which are not material to the present invention. However, as shown in FIG. 1, the frame 26, which supports various of the components shown in FIG. 2, is mounted for vertical shifting movement along a Z-axis defined by a screw 29. This screw is interconnected with the frame 26 so that there is substantially no backlash. The screw may be rotated by a servo motor 30 which, for purposes of illustration, is shown at the upper end of the main structure 18, the lower end of the screw 29 being shown journalled within a thrust bearing 32. Suitable guides (not shown) are provided to insure that the frame 26 will move vertically within the main structure 18.

Figures 4, 5, 6, 7, 8, 9, 10, 11:
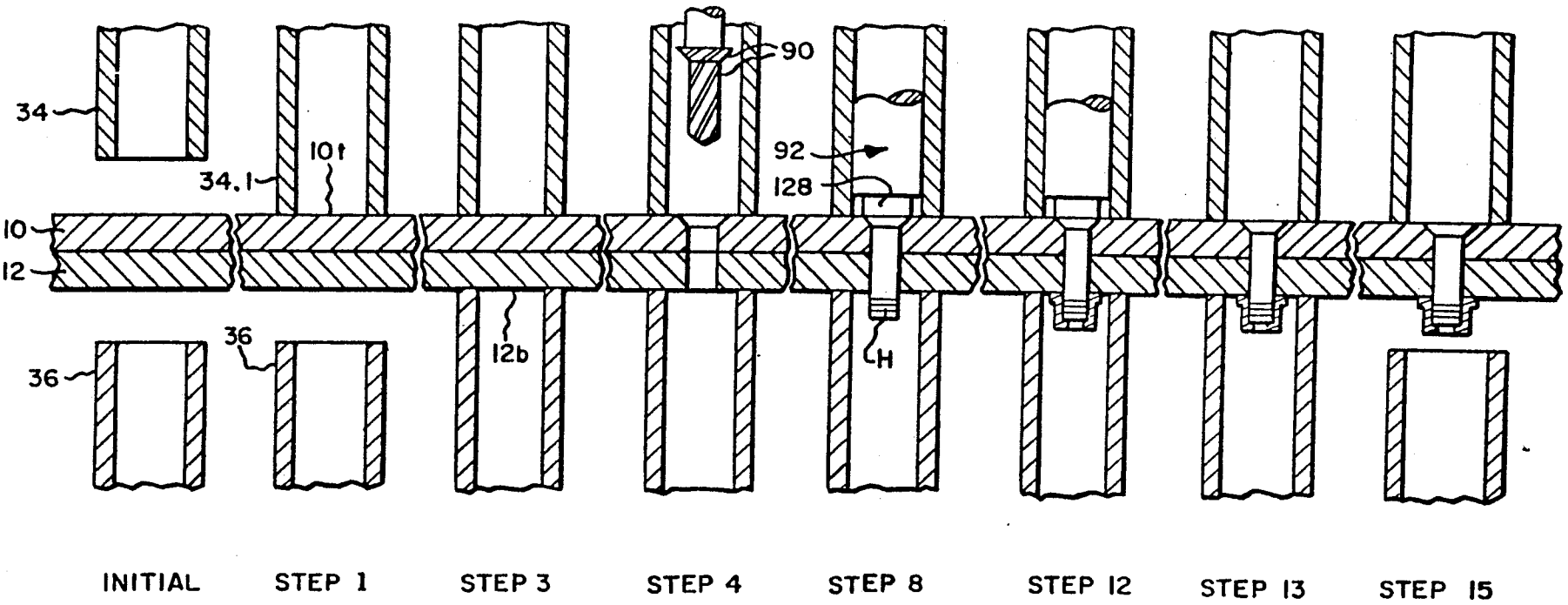
FIGS. 4 through 11 illustrate the sequence of operational steps utilized in the performance of this invention.

Clamping means are mounted on the main frame 27, the clamping means including a first upper clamp 34 and a second lower clamp 36. As can best be seen in FIG. 2 the upper clamp includes an upper pressure foot bushing 34.1 and an upper pressure foot plate 34.2. The first upper clamp 34 is interconnected with an upper clamp moving means indicated generally at 38. The upper clamp moving means includes piston rods 40, the lower ends of which rods are connected to the pressure foot plate 34.2, and the upper ends of which are secured to pistons 42 disposed within pressure foot air cylinders 44 mounted on the main frame 27. While only two air cylinder assemblies are shown in FIG. 2, in practice four may be used. By introducing air into the cylinders 44 through air lines 46*u* and 46*d* in an appropriate manner, which will be described below, the upper clamp 34 can be moved relative to the main frame 27 from a raised upper or retracted position (FIG. 4) to a lower down or extended position (FIGS. 2 and 5). While cylinders 44 are disclosed as air cylinders, in some circumstances hydraulic cylinders may be employed.

The second or lower clamp 36, which is also referred to as the lower clamp bushing, is an upper extension of a lower clamp cylinder 48, which cylinder is supported upon a lower clamp piston 50. The lower clamp piston 50 is in turn secured to the upper portion 52.1 of a piston rod 52. A lower ram piston 54 is carried by the piston rod between its upper portion 52.1 and its lower portion 52.2. The lower ram piston 54 is disposed within a lower ram cylinder 56, which cylinder is in turn rigidly secured to the main frame 27. When the lower ram piston 54 is in a lower position within the lower ram cylinder 56, air (or hydraulic fluid) introduced through line 58 into the lower clamp cylinder 48 above the lower clamp piston 50 will cause the lower clamp bushing 36 to be shifted to an extended position where the inturned flange 60 on the lower clamp cylinder 48 abuts against a stop surface 62 on the bottom of the lower clamp piston 50. Thus, low pressure air, indicated by arrow 64, is normally introduced into the lower clamp cylinder 48 through line 58, the air passing through a lower clamp pressure control or regulator valve 66. While the lower clamp 36 will normally be fully extended by the air 64 when the piston 54 is in a lower position within the cylinder 56, it will move to an intermediate position when the piston 54 is raised, as shown in FIG. 2. Thus, it should be apparent that the pressure exerted by the lower clamp 36 is determined by the setting of the regulator valve 66. It can be seen from the above that the lower clamp cylinder assembly 48, 50 and lower ram cylinder assembly 54, 56 form lower clamp moving means. The operation of the lower clamp 36 and its moving means will become more apparent after a consideration of the operation set forth below.

As previously indicated the frame 26 further includes subframe 28, the subframe being moveable between first and second positions, the subframe being shown in its second position in FIG. 2. The means for moving the subframe between its first and second positions may be a stepping motor (not shown) and threaded shaft shown partially at 68, which stepping motor may be mounted on the main frame 27. The subframe 28 may be supported in a slide-bearing portion 70 of the main frame 27 for movement in a plane which is perpendicular to the axis of the clamps 34, 36. Tooling is mounted on the subframe, which tooling includes drilling means indicated generally at 72 and a fastener inserting ram assembly indicated generally at 74. As illustrated somewhat schematically, the drilling means 72 is supported on the subframe 28 by an upwardly extending bracket 76. Thus, a cylinder assembly is mounted on the bracket 76 for moving a drill towards and away from the workpieces 10, 12, the cylinder assembly including a fixed cylinder 78, a piston 80 mounted within the cylinder 78, and a piston rod 82, the upper end of which is connected to piston 80 and which extends downwardly to its connection with a drill motor 84. The piston 80 can be moved upwardly and downwardly under the influence of a drill position control valve 86. The drill motor 84 is slideable within guides (not shown) to keep the motor from rotating. An arbor 88 extends out of the drill motor and passes through an aperture in the subframe 28. The lower end of the arbor, which is disposed below the subframe 28, is provided with a chuck (not shown) to which a drill and countersink 90 (FIG. 7) may be secured.

When the subframe 28 is in its first position the arbor 88 of the drill motor 84 will be held in a position which is concentric with the center lines of the upper and lower clamps 34, 36. When drilling the drill motor can be raised and lowered by introduction of hydraulic fluid into the cylinder 78, the drill motor being operated in any suitable manner, such as by electricity, or by fluid power. The operation of the drilling means 72 will become more apparent after a consideration of the operation set forth below.

Figure 3:
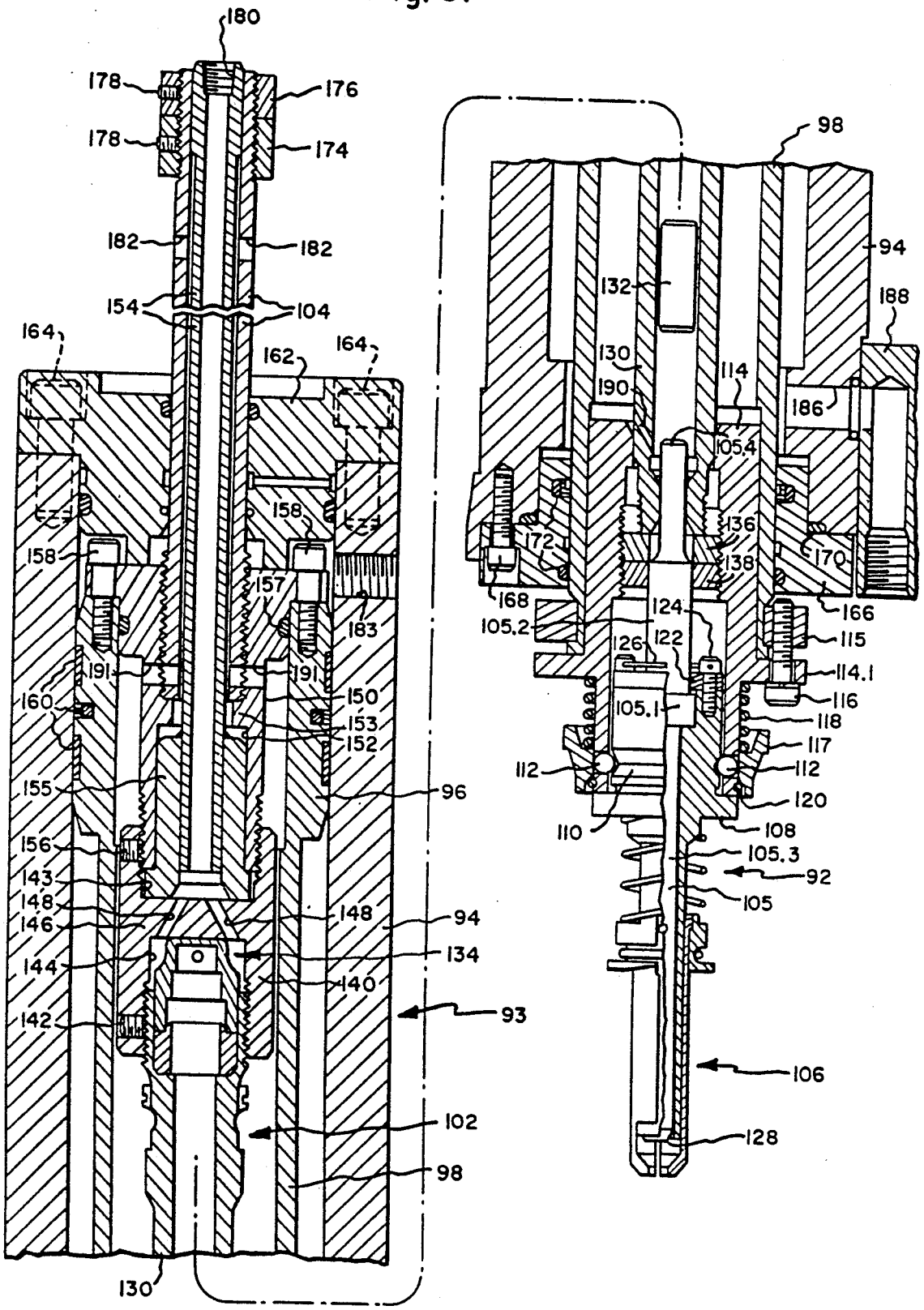
FIG. 3 is a cross-sectional view of a fastener inserting ram assembly and a ram vibrating means in the form of an air hammer motor assembly, which motor assembly is mounted within the ram assembly.

When the subframe 28 is indexed to the second position, which is shown in FIG. 2, the fastener inserting ram assembly 74 will be placed in concentric alignment with the center line of the bushings 34, 36. The fastener inserting ram assembly includes an upper ram or anvil assembly 92 and upper ram or anvil assembly moving means in the form of a buck ram cylinder assembly 93, which assembly includes a buck ram cylinder 94, a buck ram piston 96, and a tubular buck ram piston rod 98. The buck ram cylinder 94 is secured to the subframe 28 and the piston and piston rod 96, 98 are moveable in response to operation of various control valves which will be described below. Thus, the piston 96 can be moved from the lower position shown in FIG. 2 to a raised position as shown in FIG. 3. When the piston 96 is in its raised position a fastener H may be fed to the upper anvil assembly 92, which fastener is introduced by the fastener feeding means indicated generally at 100 in FIG. 2. The details of the fastener feeding means form no part of the present invention and any suitable feeding means may be utilized. Ram vibrating means are provided for vibrating the ram in order to fully insert the fastener into the workpieces and to relieve any stresses which may be present in the fastener or workpieces, the ram vibrating means including a suitable air hammer motor assembly 102 which motor assembly is carried by the tubular buck ram piston rod 98. In order to introduce air into the air hammer motor the buck ram cylinder assembly further includes a tubular piston rod extension 104, which piston rod extension extends through the upper end of the buck ram cylinder 94. This extension not only provides air to the air hammer motor 102, but also provides additional stability to the apparatus.

The details of the fastener inserting ram assembly and air hammer motor assembly are more fully illustrated in FIG. 3. As can be seen from this figure the upper anvil assembly 92 includes an upper ram or anvil 105 and fastener positioning means indicated generally at 106, the fastener positioning means being of the type illustrated in U.S. Pat. No. 4,819,856, the subject matter of which is incorporated herein by reference thereto. The upper anvil assembly further includes an anvil holder 108, which holder is provided with a radially outwardly opened V-shaped groove 110 which receives balls 112 to hold it in place, the balls being received within suitable apertures (no number) in adapter 114. The adapter 114 is provided with a suitably apertured flange 114.1. A clamp ring 115 is mounted on the lower end of tubular piston rod 98, the ring 115 being provided with suitable threaded apertures. Cap screws 116 pass through the apertures in flange 114.1 and are screwed into the apertures in ring 115 to hold the adapter 114 to the piston rod 98.

Disposed about the lower end of the adapter 114 is a cam ring 117 which is vertically shiftable from the lower securing position illustrated in FIG. 3 to a raised position which permits disassembly of the upper anvil assembly from the buck ram cylinder assembly. The cam ring is normally biased to its lowermost position by spring 118. When the cam ring is in its lowermost position it will engage a snap ring 120. The anvil 105 is provided with an enlarged diameter portion 105.1 between its upper and lower cylindrical portions 105.2 and 105.3, the enlarged diameter portion being trapped between an upper recess on the anvil holder 108 and a retaining ring 122, which ring is held in place by lock bolts 124 which are wired together by wire 126. The lower end portion 105.3 of the anvil may be suitably contoured to engage the fastener or may be provided with a die button 128.

The upper end of the anvil 105 will be impacted by the air hammer motor assembly 102 during the operation of the apparatus of this invention. To this end, the upper end of the anvil is provided with a reduced diameter portion 105.4, which reduced diameter portion is received within the lower throat of an air hammer cylinder 130. Mounted within the cylinder 130 above the upper end of the anvil 105 is a cylindrical hammer 132. The air hammer motor assembly 102 further includes, in addition to the cylinder 130 and hammer 132, a valve assembly 134 which is rigidly secured to cylinder 130. The air motor 102 is manufactured by the American Pneumatic Tool Co., Gardena, Calif. and its details form no part of the present invention.

The air hammer motor assembly 102 is rigidly mounted within the tubular buck ram piston rod 98 of the buck ram cylinder assembly. Thus the lower end of the air motor 102 is forced into contact with an upper jam nut 136 disposed in contact with a lower jam nut 138, which jam nuts are screwed into a threaded bore in adapter 114. The upper end of the air hammer cylinder 130 is threaded and a coupling 140 is screwed onto the upper end, the coupling being held in place by set screw 142. As can be seen, the coupling 140 is generally cylindrical and is provided with spaced apart threaded upper and lower generally cylindrical bores, 143, 144, respectively. The portion 146 between the upper and lower bores bears upon the top of the valve assembly 134, which portion 146 is provided with suitable apertures 148 for the passage of air to the valve assembly. The upper bore 143 receives the lowermost threaded end of an air hammer mounting adapter 150, the upper end of which is rigidly secured to piston 96. As can be seen from FIG. 3 the piston 96 is formed integrally with the tubular piston rod 98. The adapter 150 is provided with a threaded upper bore (no number) and a lower cylindrical bore 152, there being a centrally apertured web 153 extending between the upper and lower bores.

Mounted within the tubular piston rod extension 104 is a tubular air access rod 154, the upper end of which is snugly received within the upper end of the tubular piston rod extension 104, the air access rod 154 having a reduced diameter portion below its upper end. The lowermost end of the air access rod 154 is welded or otherwise rigidly secured to a flanged tubular member 155, which member is in turn received within the upper cylindrical bore of coupling 140. The flange of the member 155 is trapped between the web portion 146 of the coupling 140 and the lower end of the adapter by tightly screwing the coupling 140 onto the adapter 150, the parts being secured together by set screw 156. Thus, the adapter 150 is provided with external threads at its lower end portion, which threaded portion is screwed into the threaded upper bore of coupling 140 to secure the flanged tubular member 155 in place. The adapter 150 is also provided with an enlarged diameter upper portion which is provided with a groove that receives an O-ring 157. A flange extends outwardly of the enlarged diameter portion and rests upon the upper end of the piston 96. The upper flange portion is held to the piston 96 by means of socket head cap screws 158. The piston 96 is provided with suitable external grooves which receive suitable piston rings 160.

The threaded upper bore of the adapter 150 receives the lower threaded end of the tubular piston rod extension 104. Secured to the upper end of the buck ram cylinder 94 is an apertured bushing 162, the piston rod extension 104 passing through the aperture. The bushing 162 has a lower cylindrical portion received within the cylinder 94 and an upper flange portion which rests upon the upper end of cylinder 94, the upper flanged portion being secured in place by suitable socket head cap screws 164.

A lower throat bushing 166 is secured to the lower end of the buck ram cylinder 94 by suitable cap screws 168, only one of which is shown in the drawing. An O-ring 170 is disposed between the bushing 166 and cylinder 94 and prevents any leakage therebetween. The bushing 166 is also provided with suitable packing rings 172 which bear against the cylindrical external surface of the tubular buck ram piston rod 98.

The upper end of the tubular piston rod extension 104 is threaded and is provided with a cylindrical stop plate 174 which is held in place by a cylindrical jam nut 176, both of which cylindrical elements are in turn secured in place by set screws 178. The upper end of the air access rod 154 is threaded at 180 to form an inlet port for the introduction of air to the air hammer, used air being discharged through ports 182 which extend through an upper portion of the tubular piston rod extension 104. The port 180 is connected with a suitable source of air under pressure during the operation of the air hammer, the air flowing downwardly through the cylindrical bore of the air access rod 154, through passageways 148 through the valve assembly 134 and thence to hammer 132. Air below the hammer is discharged through bore 190 at the lower end of the air hammer motor 102 and then through ports 191 and 182.

In order to cause the buck ram piston to move downwardly a port 183 is formed in an upper end of the cylinder 94. To move the piston up a port 186 is formed in the lower end of the cylinder 94 which port is interconnected with a suitable manifold 188. The ports 183 and 186 in turn receive hydraulic fluid under the control of suitable valve means which will be described below in connection with the operation of this apparatus.

As shown in FIG. 2, in order to prevent the lower bushing 36 from collapsing when the anvil 105 is being hammered by the air hammer motor 102, lower clamp locking means are provided, which locking means are indicated generally at 192. The lower clamp locking means include locking cylinders 194 mounted upon a crossframe member 196 which is mounted on piston rod 52 between its upper and lower portions. The locking cylinders are each provided with a piston 197 and extensible piston rod 198 which, when fully extended, may contact the lower surface of flange 60 on the lower clamp cylinder 48. Fluid control means are provided for extending the piston rods 198 to their fully extended position and for locking them in such position, which fluid control means will be described below in connection with the description of the operation of this apparatus.

OPERATION

The apparatus is properly positioned by moving the apparatus with respect to the workpieces 10, 12 which are to be joined together. In order to insure proper operation, it is necessary that the lower surface of the upper pressure foot bushing 34.1 be parallel to or can conform to the top surface **10*t* of the upper workpiece 10 and initially spaced away from the top surface a distance equal to or slightly greater than the travel of the pressure foot 34.1 when shifted from its initial raised position to its operative lower clamping position where it just contacts the top surface 10*t* of the top workpiece 10. If the distance is slightly greater than the travel of the pressure foot 34.1, than the workpiece will be raised by the lower clamp assembly to contact the extended upper clamp during step 2 below. Initially the drilling means 72 will be disposed in alignment with that portion of the workpieces which are to be drilled and fastened together. Prior to the commencement of operation the pressure foot cylinder control valve 200 will be in its "raise" position, the lower ram control valve 202 will be in its "centered" position, the lower clamp lock control valve 204 will be in its "lower" position, the buck ram control valve 206 will be in its "raise" position, the drill position control valve 86 will be in its "raise" position, and the air hammer control valve 208 will be in its "blocked" position. The buck ram unlock valve 210 will be in its "open" position, and the fastener insert control valve 212 will be in its "drain" or open to reservoir position. The initial operating position of the pressure foot 34.1 and lower clamp bushing 36 is shown in FIG. 4**. After the apparatus has been initially positioned with respect to the workpieces, the following steps then take place:

1. At the commencement of operation the pressure foot 34.1 is moved all the way down by operation of the pressure foot cylinder control valve 200 which is switched from its "raise" position to its "lower" position by operation of a primary controller 214. The controller is interconnected with solenoids on the various control valves by control lines 1–9. In addition the controller is also connected with various feedback devices, which will be described later, by feedback lines A–F. When the valve 200 is switched, fluid flow to the pressure foot air cylinders 44 will cause the pistons 42 to bottom out in their respective cylinders 44, causing the piston rods 40 to be fully extended. The completion of this step is shown in FIG. 5. The frame 27 may also be shifted vertically to insure that the lower surface of the pressure foot 34.1 is in contact with the upper surface **10*t* of the upper workpiece 10**, which upper surface lies in a desired work plane indicated by the dot-dash line WP.

2. When the pressure foot 34.1 contacts limit switch 216, the primary controller 214 will cause the lower clamp bushing 36 to be moved upwardly until it contacts the under side **12*b* of the workpiece 12. This operation is commenced by shifting the lower ram control valve 202 to its "raise" position which will cause fluid to raise the lower ram piston 54, lower clamp piston 50, lower clamp cylinder 48 and lower clamp bushing 36. Continued upward movement of the lower clamp bushing 36 will continue until workpieces 10 and 12 become tightly sandwiched between the clamps 34.1 and 36. However, the lower clamp piston 50 is continued to be moved upwardly after clamping is achieved, and fluid disposed within the lower clamp cylinder 48 is forced out through the pressure control valve 66 which holds the fluid within cylinder 48 at a constant pressure. This maintains a constant force between the clamps 34.1 and 36**.

3. Step 2 will be completed when the clamp signal device or switch 218 is actuated which will send a signal to the primary controller 214 through feedback line B. The controller 214 will in turn command lower ram control valve 202 to shift to its blocking position, thereby locking the lower ram piston 54 in place within lower ram cylinder 56. The clamp signal device 218 may be a proximity sensor switch which senses the position of the lower clamp cylinder 36 with respect to the lower clamp piston 50. The device 218 is adjustable during initial machine set-up to account for physical differences between machines and to insure that when the piston rods 198 are fully extended (step 6) that the upper ends of the rods will just contact the lower surface of the flange 60 on the lower clamp cylinder 48. The completion of this step is illustrated in FIG. 6.

4. Aligned apertures are then drilled through the workpieces 10 and 12. At the same time an optional countersink may be produced in the workpiece 10 to a preset depth. The drill and countersink 90 (FIG. 7) for the above is carried by a subframe 28 which also supports the buck ram cylinder 94. Thus the drill, which initially is in the proper position for drilling the hole, is caused to be moved downwardly by the primary controller 214 sending a signal to the drill position control valve 86 to cause it to shift to its "lower" position to extend piston rod 82 downwardly, the drill being rotated at the same time by motor 84. During the drilling operation a fastener H, which may be a Huck fastener or the equivalent or a threaded fastener, is inserted in the cavity below the first riveting ram or upper anvil 105, for example by the method and apparatus disclosed in the above identified U.S. patent. In addition, an automatic collar feeding device 220 may insert a collar into proper position above a collar fastening die at the upper end of the second ram 58, a collar feeding device being shown in SME technical paper AD84-842 entitled "Two Piece Fasteners and Installation Tooling." After drilling and prior to the completion of the drilling step the drill bit 90 will be retracted so that it is above the top of the upper pressure foot plate 34.2. The drilling step is illustrated in FIG. 7.

5. The subframe 28 which carries the drilling apparatus is then indexed to another position to place the fastener inserting ram assembly in an operative position wherein it is aligned with the drilled apertures in workpieces 10, 12.

6. The lower clamp cylinder 48, which supports the lower clamp bushing 36, is now caused to be locked in its raised position by causing pistons 197 to top out in their respective cylinders 194, thereby fully extending piston rods 198 to a full up position, the upper ends of rods 198 bearing against a lower surface 1 of the flange 60 of cylinder 48. The foregoing is accomplished by operation of the control valve 204, which valve is caused to be shifted from its piston "down" position to its piston "up" position by operation of the primary controller 214. Incorporation of cylinder lock valve or pilot operated check valve assembly 222 insures that the workpieces cannot shift downwardly when the fastener 4 is inserted.

7. The buck ram control valve 206 is now shifted to its center position and simultaneously the buck ram unlock valve 210 is switched from its open position, where it holds check valve 224 in an open position, to its closed position. The buck ram piston 96 is held in place by the action of spring biased check valve 226 which has sufficient cracking pressure to maintain oil pressure in area 228 such that the weight of the piston 96 and associated parts cannot force oil past it.

8. Fastener insert control valve 212 will now be caused to be operated by the primary controller 214, valve 212 being shifted from its "drain" position to a "lower" position to cause the first riveting ram 105 to be moved downwardly. As the ram 105 is moved downwardly, fluid within cylinder 94 below piston 96 will be pressurized sufficiently to open check valve 226, permitting fluid to be discharged to reservoir. As the ram attains its lower position the fastener H will be forced into the aligned apertures which were drilled in step 4. Movement of the ram 105 downwardly will cease when the head of the fastener contacts the workpiece 10, in this case being the countersunk surface. The completion of this step is shown in FIG. 8.

9. The ram will be maintained under pressure and excess fluid which passes through the fastener insert control valve 212 will be vented to reservoir through pressure relief valve 230. Flow from relief valve 230 is caused to pass through a spring biased check valve 232. This will cause a pressure increase in the fluid line 234 between the relief valve 230 and check valve 232, which pressure increase triggers pressure sensor 236. The signal from 236 is sensed by the primary controller 214. Also, the ram will be locked in its down position by check valves 224 and 238.

10. The primary controller now initiates the operation of air hammer assembly 102 by causing air hammer control valve 208 to shift from its blocked position to an open position wherein air under pressure is directed to the air hammer assembly 102, causing the upper end 105.4 of the ram 105 to be impacted a number of times by the air hammer 132 during a time period determined by the setting of a timer within the controller. This will fully insert the fastener in the drilled apertures and relieve any stresses which may be present. This step is illustrated in FIG. 2.

11. At the end of the above time period the timer times out, signaling the primary controller 214 to shift air hammer control valve 208 to its blocked position which will cause the air hammer to cease operation. At the same time the controller will shift the fastener insert control valve 212 back to its blocking position stopping oil flow through pressure relief valve 230.

12. Optionally, at this point, and with suitable tooling installed on the lower clamp means 36, a collar may be swaged or a nut may be threaded on the lower end of fastener H. Thus, for example as shown schematically in FIG. 2, an automatic collar feed and swage assembly 220 may be disposed between the lower ram 52, 54 and the upper end of the lower clamp bushing 36. This type of equipment is used with a pin H provided with annular grooves and a collar which is swaged about the lower end of the pin. Thus, a collar may be fed by the collar feed to a location below the lower end of the pin H, and a swage may then be moved upwardly to swage the collar about the pin, which swage will then be moved downwardly at the completion of this optional step, which completed step is shown in FIG. 9.

13. At the completion of step 11, or optional step 12, a signal is sent by the tooling to the primary controller 214 which causes the buck ram control valve 206 to be shifted from its "center" position to its "raise" position and valve 210 to shift to pressurize pilot operated check valve 224 causing it to open. This will cause ram 105 to raise.

14. When the air hammer assembly, which is carried above and in contact with the ram, contacts limit switch 240 a signal will be sent to the primary controller which will then cause the lower clamp lock control valve 204 to shift from its "raise" position to its "lower" position to cause the stop piston rods 198 to travel down, the associated pistons 197 bottoming out in their cylinders 194.

15. The resultant pressure buildup in line 242 triggers pressure switch 244. The signal from switch 244 causes the primary controller 214 to shift the lower clamp valve 202 from its "blocking" position to its "lower" position to initially cause the piston 54 to move downward. Due to the air pressure in chamber 246 the downward movement of piston 54 causes a corresponding upward movement of cylinder 48 with respect to piston 50 until the lower surface of piston 50 contacts the upper surface on the lower flange 60 of cylinder 48. Further upward movement of cylinder 48 with respect to piston 50 is no longer possible, and therefore cylinder 48 will move downward with the lower ram piston and piston rod to cause the lower clamp bushing 36 to move away from the lower surface 12*b* of the lower workpiece 12 resulting in the unclamping of workpieces 10, 12.

16. When limit switch 248 is contacted by the cross frame member on piston rod 52 a signal is sent to the primary controller 214 which will in turn cause a signal to be sent to valve 202 to shift it to it's blocked position, thereby stopping the lowering of the lower ram 52, 54.

17. The indexable subframe 28 will now be indexed back to its drill position.

18. When the subframe 28 has achieved its drilling position (which is sensed by a limit switch not shown), the primary controller will now shift the first clamp cylinder control valve 200 from its "lower" position to its raised position to cause the first clamp means to be raised away from the top surface of workpiece 10.

19. The apparatus of this invention is now moved with respect to the workpieces 10, 12 to its next fastener insertion position.

What is claimed is:

1. An apparatus for inserting a fastener into side-by-side upper and lower workpieces, said apparatus comprising:

a frame;

upper and lower opposed spaced apart clamps mounted for movement towards and away from each other between extended and retracted positions, respectively;

upper clamp moving means extending between the frame and the upper clamp and capable of moving the clamp between an upper retracted position and a lower extended position;

lower clamp moving means extending between the frame and the lower clamp and capable of moving the lower clamp between a lower retracted position and an upper extended position;

an upper ram mounted for movement between raised and lowered positions;

fastener positioning means carried by the frame and capable of positioning a fastener below the upper ram when the upper ram is in its raised position;

upper ram moving means extending between the frame and the upper ram and capable of moving the ram between raised and lowered positions; and ram vibrating means carried by the upper ram moving means and capable of hammering the upper ram when it is in its lower position to fully insert a fastener and relieve any stresses which may be present in the fastener or workpieces.

2. The apparatus set forth in claim 1 further comprising a lower clamp locking means engageable with the lower clamp and capable of locking the lower clamp in its extended position.

3. The apparatus as set forth in claim 1 wherein the ram vibrating means includes an air hammer assembly.

4. The apparatus as set forth in claim 1 further comprising drilling means capable of drilling aligned apertures into the workpieces, and drill moving means extending between the drilling means and the frame and capable of moving the drilling means between a raised inoperative position and a lowered operative position.

5. The apparatus as set forth in claim 1 wherein the apparatus further includes collar positioning and swaging means capable of swaging a collar about the lower end of a fastener after it has been inserted through the workpieces.

6. The apparatus as set forth in claim 1 further characterized by the provision of frame moving means capable of moving the frame in a direction parallel to the top surface of the upper workpiece.

7. An apparatus for inserting a fastener into side-by-side upper and lower workpieces, the apparatus comprising:

a frame including a main frame and a subframe mounted on the main frame and moveable between first and second positions;

tooling interconnected with the subframe, the tooling including a drill and an upper ram;

upper and lower opposed spaced apart clamps interconnected with the main frame;

upper clamp moving means extending between the main frame and the upper clamp and capable of moving the upper clamp between an upper retracted position and a lower extended clamping position;

lower clamp moving means extending between the main frame and the lower clamp and capable of moving the lower clamp between a lower retracted position and an upper extended clamping position;

drill moving means extending between the drill and the subframe and capable of moving the drill between a raised retracted position and a lowered drilling position;

upper ram moving means extending between the subframe and the upper ram and capable of moving the upper ram between raised and lowered positions;

fastener positioning means carried by the frame and capable of positioning a fastener below the upper ram when the upper ram is in its raised position; and ram vibrating means carried by the upper ram moving means and capable of hammering the upper ram when it is in its lower position to fully insert a fastener and relieve any stresses which may be present in the fastener of workpieces.

8. The apparatus as set forth in claim 7 wherein the upper ram moving means includes a cylinder carried by the subframe, a piston rod extending downwardly from the cylinder, and a piston disposed within the cylinder, the upper end of the piston rod being connected to the piston, the upper ram being supported by the downwardly extending piston rod.

9. The apparatus as set forth in claim 8 wherein said piston rod is hollow, and wherein the ram vibrating means is carried by the hollow piston rod, the ram vibrating means being an air hammer assembly including a hammer adapted to impact directly upon the upper end of the upper ram.

10. The apparatus as set forth in claim 7 further comprising controller means, valve means interconnected with the upper ram moving means and the vibrating means, which valve means are capable of being operated by said controller means, and suitable interconnections therebetween.

11. The apparatus as set forth in claim 7 further comprising lower clamp locking means capable of locking the lower clamp in its upper extended clamping position during the operation of the ram vibrating means.

* * * * *